US005651384A

United States Patent [19]

Rudrich

[11] Patent Number: 5,651,384

[45] Date of Patent: Jul. 29, 1997

[54] CONTROL FOR A SANITARY FIXTURE

[75] Inventor: Hans-Peter Rudrich, Windischeschenbach, Germany

[73] Assignee: Friedrich Grohe AG, Hemer, Germany

[21] Appl. No.: 590,584

[22] Filed: Jan. 24, 1996

[30] Foreign Application Priority Data

Jan. 25, 1995 [DE] Germany ..... 195 02 148.7

[51] Int. Cl.[6] ..... E03C 1/05; F16K 31/06

[52] U.S. Cl. ..... 137/1; 251/129.04; 4/304; 4/623; 137/624.11

[58] Field of Search ..... 251/129.04; 4/623, 4/304, 313, DIG. 3; 137/1, 624.11

[56] References Cited

U.S. PATENT DOCUMENTS

| | | | |
|---|---|---|---|
| 4,722,372 | 2/1988 | Hoffman et al. | 4/623 X |
| 5,063,622 | 11/1991 | Tsutsui et al. | 251/129.04 X |

FOREIGN PATENT DOCUMENTS

| | | |
|---|---|---|
| 0473345 | 3/1992 | European Pat. Off. . |
| 0547415 | 6/1993 | European Pat. Off. . |
| 2706504 | 12/1994 | France . |
| 9210464 | 11/1992 | Germany . |
| 4218658 | 12/1992 | Germany . |
| 29502329 | 5/1995 | Germany . |
| 8802707 | 6/1990 | Netherlands . |
| 2195763 | 4/1988 | United Kingdom . |

*Primary Examiner*—Kevin Lee
*Attorney, Agent, or Firm*—Herbert Dubno

[57] ABSTRACT

An infrared proximity sensing circuit for use with sanitary fixtures to control water flow can have an ambient light proximity sensor which can control the period at which the circuit and the sensor are activated or the amplitude of the transmitted infrared power to conserve battery power when the circuit is a battery powered one. The ambient light sensor detects the ambient brightness and the time period of the circuit and the proximity sensor is changed upon the detected ambient brightness falling below the threshold brightness.

14 Claims, 1 Drawing Sheet

CONTROL FOR A SANITARY FIXTURE

FIELD OF THE INVENTION

My present invention relates to a method of operating a sanitary fixture and, more specifically, a control for a sanitary fixture, especially a water-flow control for a sanitary fixture unit with a proximity sensor of the clocked or pulsed infrared light type, a control and evaluating circuit connected with that sensor, and a valve for operation by that circuit.

The invention also relates to the control system or device.

BACKGROUND OF THE INVENTION

Battery-operated sanitary fixture controls which utilize reflected infrared light from an emitter to a receiver to detect the presence of a user and thus initiate water flow, generally are operated by the generation of infrared transmitted pulses or pulse trains at time-spaced intervals, usually periodically, so that the presence of an object or body in the path of the emitted infrared light pulses will reflect the pulses to a receiver and the latter can transduce the received light signal into electrical signals which, in the control and evaluating electronic circuit connected to the sensor, to determine the presence of a user. Water flow can then be initiated based upon the use of the fixture.

Depending upon the evaluation of the electrical signal in the control circuit, a valve can be operated. The valve may be a solenoid or magnetically-operated valve.

To distinguish between foreign infrared radiation and infrared radiation generated by the transmitter or emitter of the sensor, the transmitter is generally pulsed to produce a pulse train or a modulated infrared output. In such systems it is not uncommon to provide individual pulses or shortened pulse trains until detection of an object in the path of the infrared radiation is achieved so that only upon the probable or possible presence of an object, such as the body of a potential user in the detection region will the water flow be commenced. This avoids water flow during inappropriate periods. When detection is plausible, of course, the number of pulses per unit time can be increased or longer pulse sequences or trains can be used to detect the proximity of a user.

These systems, which operate with constant time intervals between the individual transmitted IR pulses or pulse groups, operate independently from the ambient light levels which may be present.

Since the primary current-consuming component of such a water control system for a sanitary fixture is generally the infrared transmitter, because it operates in conventional systems continuously to meet the individual pulses or pulse groups even though the intervals between them may be lengthened until the presence of a user is detected, the useful life of a battery driving the system is greatly limited. Battery change must be carried out frequently and, for sanitary fixtures which must be sealed, the changing operation may be onerous.

OBJECTS OF THE INVENTION

It is the principal object of the present invention to provide a method of and an apparatus for controlling flow of water for a sanitary fixture which can significantly reduce the energy consumption of the control system so that battery life is increased and the frequency of battery replacement or recharge is reduced.

It is another object of the invention to provide an improved method of operating a sanitary fixture and particularly a control device therefor, which can avoid drawbacks of earlier systems.

Another object of the invention is to provide an improved control with battery power whereby the drain on the battery is substantially reduced.

SUMMARY OF THE INVENTION

These objects and others which will become apparent hereinafter are attained, in accordance with the invention, in a method of operating a pulsed-infrared sensor system for the proximity detection of a potential user of a sanitary fixture and having a control and evaluation circuit and, generally, a water valve controlled by this circuit. According to the invention the circuit and the sensor are periodically activated and deactivated and the sensor is provided with an additional receiver responsive to visible light and a timing circuit controlled by this additional receiver for increasing the cadence or interval between periods of activation of the circuit below a certain brightness of the ambient light detected by the additional receiver, thereby switching the circuit to an energy-sparing mode and conserving the electrical energy. The circuit is switched over from the long period ($t_2$) to a shorter period ($t_1$) for normal operation of the proximity sensor in a normal operating mode when the ambient light detected by the additional receiver exceeds a threshold.

According to the invention, moreover, the sensor for the ambient light can reduce the infrared power output from the emitter of the sensor unit when the ambient light falls below a predominant minimum brightness.

Preferably the system is battery operated.

More particularly, a method of operating a sanitary fixture in accordance with the invention can comprise the steps of:

(a) periodically activating a proximity sensor capable of detecting presence of a potential user of a sanitary fixture at intervals with a certain cycling period, whereby detection of the presence of a user initiates an operation of the sanitary fixture;

(b) detecting an ambient brightness; and (c) upon the detected ambient brightness reaching a threshold, altering the cycling period to decrease the cycling period upon an increased probability of use of the sanitary fixture and to increase the cycling period upon a decreased probability of use of the sanitary fixture.

Alternatively the method can comprise the steps of:

(a) activating an infrared proximity sensor emitting infrared light and receiving reflected infrared light and positioned to detect presence of a potential user of a sanitary fixture whereby detection of the presence of a user initiates an operation of the sanitary fixture;

(b) detecting an ambient brightness; and (c) upon the detected ambient brightness falling below a threshold of ambient brightness, altering power of the emitted infrared light for energy conservation.

The apparatus can comprise:

at least one sanitary fixture mechanism operable upon use of the sanitary fixture;

an electrically operable proximity sensor for detecting proximity of a user for activating the mechanism;

a control and evaluation circuit connected to the sensor for activating the sensor and responding to detection of proximity of the user by the sensor, the circuit having a timing network for periodically activating the proximity sensor at intervals with a certain cycling period, whereby detection of the presence of a user initiates an operation of the sanitary fixture mechanism; and means for detecting ambient brightness connected to the circuit for altering the cycling period upon detected ambient brightness falling to a threshold to decrease the cycling period in an energy conservation mode of operation.

Preferably the mechanism is a valve for controlling water flow to the sanitary fixture, the proximity sensor is an infrared light sensor emitting infrared light and receiving reflected infrared light, the timing network operating the circuit with a relatively short cycling period ($t_1$) for a normal mode operation of the sanitary fixture, and the means for detecting ambient brightness is a visible light detector responsive to the ambient light for switching the timing network to operate the circuit with a relatively long cycling period ($t_2$) in an energy conservation mode operation.

The system of the invention has the advantage with battery-operated sanitary fixtures that it provides a significantly longer useful life for a given battery charge especially since the energy required for the active IR sensor is minimized during natural periods of probable nonuse, mainly night time. This can be achieved by reducing the transmitted signal or increasing the time interval between two successive transmitted signals when the actual ambient light indicates that a utilization of the sanitary fixture is no longer probable, i.e. a certain threshold for the ambient light brightness is met as ambient darkness falls. The drawback of all earlier systems using active IR sensors is that, even in the absence of a potential user, operation of the device will be triggered, which is most pronounced in weak lighting circumstances or as darkness falls or as daybreak occurs can be excluded.

The natural nonuse periods can be, for example, night time when the fixture is provided in a private dwelling or during periods of darkness in public places, as in the case of toilets operated for establishments available to the public at night.

In some cases the period of lowest probability of usage is during twilight or in a dim-light situation.

It has been found to be advantageous to trigger the operation of the energy saving mode at a threshold corresponding to the perception of the human eye for ambient light although some other threshold of available light may be used.

According to a feature of the invention, the control circuit of an automatic sanitary fixture operating by the contactless detection of the presence of a user can be expanded to detect and evaluate the actual ambient light brightness. Depending upon this brightness, the intensity of the transmitter signal can be reduced or the interval between the transmitted signals or transmitted pulses can be increased. Advantageously, the measurement of the ambient light is effected with the receiver available in the sensor whose sensitivity can be appropriately adjusted (e.g. raised).

The "night lowering" or switch-over to the energy sparing mode upon darkening can be reproduced by adhesively bonding a light impermeable sticker onto the sensor housing or by introducing the valve and its circuits into a light-impermeable packaging. In this case, the unit can be stored for a long period of time and transported from the factory to the locale of installation with reduced energy consumption.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
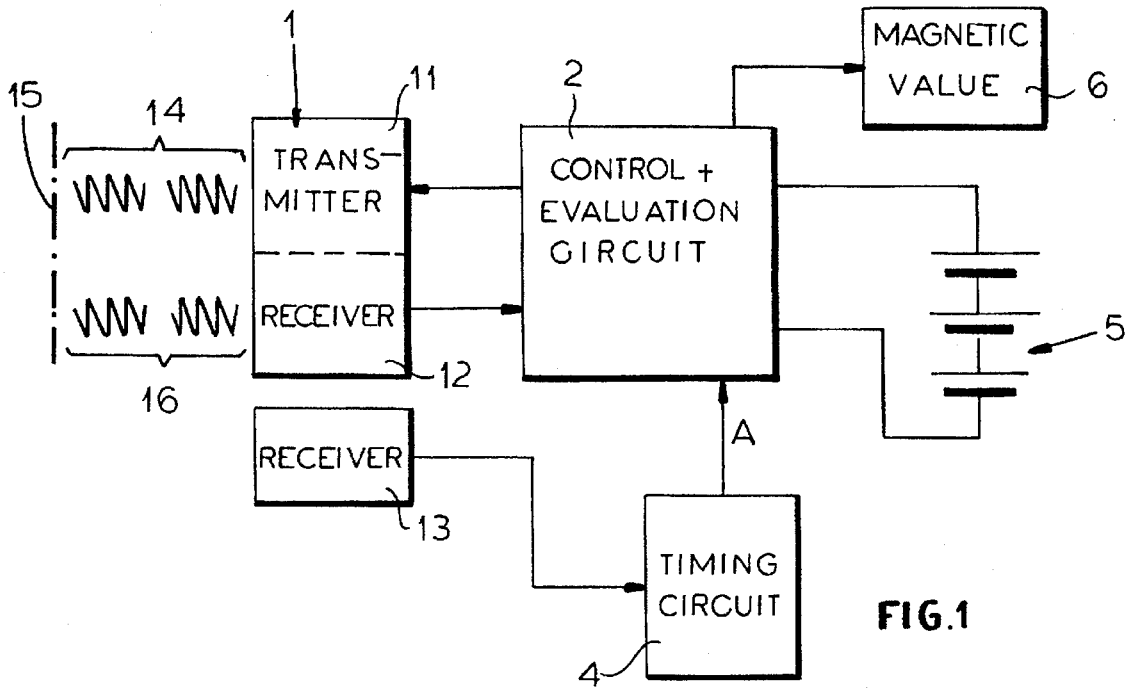
FIG. 1 is a block diagram of a control for a sanitary fixture according to the invention.

The block diagram shown in FIG. 1 represents the control system for a sanitary fixture having an electromagnetic valve 6 controlling the flow to the sanitary fixture which may be, for example, a shower, a urinal, a toilet or the like in which the valve opens to permit water flow when a user is proximal to the fixture.

The system includes a control and evaluation circuit 2 to which a sensor module i is connected with its transmitter 11 and its receiver 12. The transmitter emits pulses of infrared light represented at 14 which can impinge upon the body of a user shown as a surface 15 so that reflected pulses of infrared light are returned at 16 to the receiver 12. A battery 5 supplies electric power for the system and in a normal mode of operation, the transmitter i sends out pulses of infrared light or pockets of such pulses, sending a number of pulse trains which upon reflection by the user are detected in the receiver 12 and the resulting electrical signals are evaluated in the circuit 2 and the current from the battery 5 transmitted to the magnetic valve 6 to open the latter when a user in in the appropriate proximity and after a delay if desired or continuously while the user is in the presence of the sensor 1.

The circuit 2, however, is also provided with a timing network 4 by means of which control signals A can be supplied to the circuit 2 so that the latter and the transmitter 11 are activated periodically with a time interval $t_1$ between pulses, whereby an interval $\tau$ represents the duration of proximity detection, i.e. the active period of the circuit and the transmitter.

Figure 2:
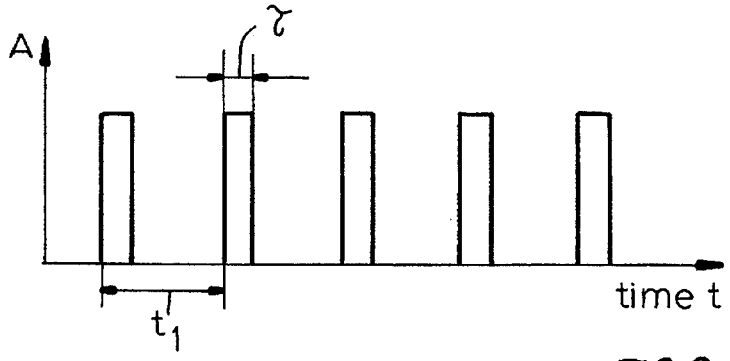
FIG. 2 is a pulse-timing diagram illustrating the operation of that system, the signal leveling being plotted along the ordinate against the time $t_1$ along the abscissa.

FIG. 2 shows the normal operating mode of the circuit 2, the signal level being plotted along the ordinate against time t along the abscissa. From this Figure it will be apparent that only the timing unit 4 is continuously active and triggers after a time span $t_1$-$\tau$, a new activation of the circuit 2.

With an interval between generation of the infrared signals $t_1$, during each active phase $\tau$, a transmitted infrared pulse is emitted by the transmitter 11 and can be reflected to the receiver 12 should a user be present or will not be reflected to the receiver 12 should a user be absent.

According to the invention, the system has a further receiver 13 which is connected to the timing circuit 4. The receiver 13 is sensitive to the visible light spectrum and can be used to determine the ambient brightness. By contrast, the receiver 12 may be sensitive only to infrared light.

Figure 3:
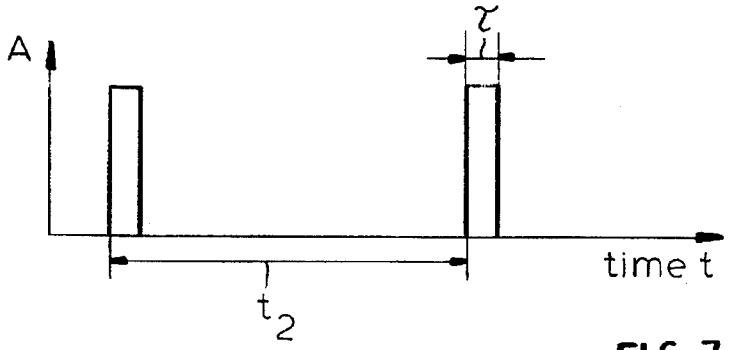
FIG. 3 is a graph corresponding to FIG. 2 showing an increase in the period of the pulses.

When the ambient brightness detected by the receiver 13 falls below a certain predetermined value, the control signal A used to activate the circuit 2 is switched over to a greater time interval $t_2$ as has been shown in FIG. 3. The energy required to supply the system of FIG. 1 in the case of the timing of FIG. 2 is given by the equation:

$$E_1=k\cdot\tau\cdot t/t_1$$

whereby k is the constant relating the energy consuming by the electronic components and the transmitter to the duration. With activation of the night time or energy-saving mode (FIG. 3), the energy equation becomes:

$$E_2=k\cdot\tau\cdot t/t_2$$

as a consequence, the greater duration $t_2$, the greater the reduction in energy consumption $E_2$ by comparison with $E_1$. The threshold for the ambient light intensity at which the switchover raises the duration of the control signal to $t_2$, is advantageously in the region of the limit of detection of visible light by the human eye. This ensures that the system will be automatically switched over to the energy conservation mode when utilization of the valve is not to be expected or is not possible, solely by determination of ambient light conditions.

The invention can also be realized by detecting the ambient light directly with the receiver 12 which would not, therefore, be provided with the usual daylight filter provided on an infrared receiver.

The invention can provide a nonlinear control of the measurement interval $t_1$ in dependence upon the lighting amplitude in receiver 12 or 13.

In a further evaluation the circuit itself can select or calculate the light amplitude in the receiver 12 which is suitable to establish the diameter interval for the next activation of the IR sensor.

Finally reduction of the energy consumption in the control can also be effected by reducing the IR transmission power in the case of a period of probably nonuse, i.e. twilight or oncoming darkness.

I claim:

1. A method of operating a sanitary fixture comprising the steps of:

(a) periodically activating a proximity sensor capable of detecting presence of a potential user of a sanitary fixture at intervals with a certain cycling period, whereby detection of the presence of a user initiates an operation of said sanitary fixture;

(b) detecting an ambient brightness at least during periodic activation of the proximity sensor; and (c) upon the detected ambient brightness reaching a threshold brightness, altering said cycling period to decrease said cycling period upon an increased probability of use of the sanitary fixture and to increase said cycling period upon a decreased probability of use of the sanitary fixture.

2. The method defined in claim 1 wherein said sanitary fixture has a valve for controlling water flow to said sanitary fixture, said proximity sensor is an infrared light sensor emitting infrared light and receiving reflected infrared light, said sensor being provided with a control and evaluation circuit for activating the sensor, evaluating infrared signals acquired thereby, and controlling said valve, said circuit having a timing network for operating said circuit with a relatively short cycling period ($t_1$) for a normal mode operation of said sanitary fixture, and having a visible light detector responsive to said ambient light, the method comprising switching said timing network to operate said circuit with a relatively long cycling period ($t_2$) in an energy conservation mode operation.

3. The method defined in claim 2 wherein said threshold brightness corresponds approximately to a light-perception limit of human sight.

4. The method defined in claim 1 wherein said sensor is used as a detector for said ambient brightness.

5. The method defined in claim 1 wherein said cycling period is altered nonlinearly in dependence upon ambient illumination.

6. The method defined in claim 2 wherein the timing network itself determines the time interval until a next activation of said circuit.

7. A method of operating a sanitary fixture comprising the steps of:

(a) activating an infrared proximity sensor emitting infrared light and receiving reflected infrared light and positioned to detect presence of a potential user of a sanitary fixture whereby detection of the presence of a user initiates an operation of said sanitary fixture;

(b) detecting an ambient brightness at least during periodic activation of the proximity sensor; and (c) upon the detected ambient brightness falling below a threshold value of ambient brightness, changing a power of said emitted infrared light for energy conservation.

8. A sanitary fixture comprising:

at least one sanitary fixture mechanism operable upon use of the sanitary fixture;

an electrically operable proximity sensor for detecting proximity of a user for activating said mechanism;

a control and evaluation circuit connected to said sensor for activating said sensor and responding to detection of proximity of said user by said sensor, said circuit having a timing network for periodically activating said proximity sensor at intervals with a certain cycling period, whereby detection of the presence of a user initiates an operation of said sanitary fixture mechanism; and means for detecting ambient brightness at least during periodic activation of the proximity sensor connected to said circuit for altering said cycling period upon detected ambient brightness falling to a threshold brightness to decrease said cycling period in an energy conservation mode of operation.

9. The apparatus defined in claim 8, further comprising at least one battery forming a power source connected to said circuit.

10. The apparatus defined in claim 9 wherein said mechanism is a valve for controlling water flow to said sanitary fixture, said proximity sensor is an infrared light sensor emitting infrared light and receiving reflected infrared light, said timing network operating said circuit with a relatively short cycling period ($t_1$) for a normal mode operation of said sanitary fixture, and said means for detecting ambient brightness is a visible light detector responsive to said ambient light for switching said timing network to operate said circuit with a relatively long cycling period ($t_2$) in an energy conservation mode operation.

11. The apparatus defined in claim 10 wherein said threshold brightness corresponds approximately to a light-perception limit of human sight.

12. The apparatus defined in claim 10 wherein said sensor is said detector.

13. The apparatus defined in claim 9 wherein said cycling period is altered nonlinearly in dependence upon ambient illumination.

14. The apparatus defined in claim 10 wherein the timing network itself determines the time interval until a next activation of said circuit.

* * * * *